US006091367A

United States Patent [19]

Kabashima et al.

[11] Patent Number: 6,091,367

[45] Date of Patent: Jul. 18, 2000

[54] LIGHT-WEIGHT FLAT ANTENNA DEVICE TOLERANT OF TEMPERATURE VARIATION

[75] Inventors: Shigenori Kabashima; Tsuyoshi Ozaki; Toru Takahashi; Yoshihiko Konishi; Masataka Ohtsuka, all of Tokyo, Japan

[73] Assignee: Mitsubishi Denki Kabushiki Kaisha, Tokyo, Japan

[21] Appl. No.: 09/162,438

[22] Filed: Sep. 29, 1998

[30] Foreign Application Priority Data

Sep. 30, 1997 [JP] Japan ..... 9-265549
Jun. 23, 1998 [JP] Japan ..... 10-176412

[51] Int. Cl.[7] ..... H01Q 1/38

[52] U.S. Cl. ..... 343/700 MS; 343/846

[58] Field of Search ..... 343/700 MS, 846, 343/897, 909; H01Q 1/38

[56] References Cited

U.S. PATENT DOCUMENTS

| | | | |
|---|---|---|---|
| 4,320,403 | 3/1982 | Ebneth et al. | 343/897 |
| 4,812,854 | 3/1989 | Boan et al. | 343/897 |
| 4,851,855 | 7/1989 | Tsukamoto et al. | 343/700 MS |
| 4,864,314 | 9/1989 | Bond | 343/700 MS |
| 5,218,368 | 6/1993 | Huruno et al. | 343/700 |
| 5,430,451 | 7/1995 | Kawanishi et al. | 342/354 |

FOREIGN PATENT DOCUMENTS

| | | | |
|---|---|---|---|
| 0 507 307 | 10/1992 | European Pat. Off. . | |
| 60-10805 | 1/1985 | Japan | H01Q 1/28 |
| 3157005 | 7/1991 | Japan | H01Q 13/08 |

OTHER PUBLICATIONS

Stockton, R.J.; "Large L–Band Radiometer Array", AP–S International Symposium (IEEE), May 15–19, 1978, pp. 446–449.

Murata et al.; "A printed Antenna with Two–Layer Structure for Satellite Broadcast Reception", Electronics and Communications in Japan, Part I, vol. 73, No. 4, pp. 81–90, 1990.

Patent Abstracts of Japan, vol. 009, No. 123 (E–317) May 28, 1985, JP60010806A, Jan. 21, 1985.

*Primary Examiner*—Michael C. Wimer
*Attorney, Agent, or Firm*—Leydig, Voit & Mayer

[57] ABSTRACT

A flat antenna device is constructed such that circular patches are provided on one surface of a dielectric film, a metallic grounding conductor film is fitted to one surface of a dielectric film, a dielectric member is sandwiched between the dielectric film and the dielectric film, and an extending mechanism is provided to the periphery of the device so as to maintain the dielectric film and the dielectric film in a fully extended state. A circular microstrip patch antenna is formed by the metallic grounding conductor film and each of the circular patches.

15 Claims, 10 Drawing Sheets

PRIOR ART

LIGHT-WEIGHT FLAT ANTENNA DEVICE TOLERANT OF TEMPERATURE VARIATION

BACKGROUND OF THE INVENTION

1. Field of the Invention

The present invention generally relates to flat antenna devices and, more particularly, to a flat antenna device applicable to communication, a radar apparatus, etc which is light and which is not easily deformed due to a temperature change.

2. Description of the Related Art

FIG. 11 shows a prior art flat antenna device disclosed, for instance, in Japanese Laid-Open Patent Application No. 60-10805. Reference numeral 8 indicates a radiation element, numeral 9 indicates a honeycomb dielectric core, numeral 10 indicates a grounding conductor, and numerals 11*a* and 11*b* indicate dielectric skins. In this antenna device, a microstrip patch antenna is formed by sandwiching the honeycomb dielectric core 9 and the dielectric skins 11*a* and 11*b* between the rectangular radiation element 8 and the grounding conductor 10.

When the weight of the prior art flat antenna device as constructed above is to be reduced, the honeycomb dielectric core 9 may be enlarged or the dielectric skins 11*a* and 11*b* may be made thin. When the weight of the flat antenna device is reduced by enlarging the honeycomb dielectric core 9, there is a problem in that the flatness of the flat antenna device is deteriorated due to the bending of the dielectric skins 11*a* and 11*b*, resulting in deterioration in the electric performance of the device.

The weight of the flat antenna device may also be reduced by making the dielectric skins 11*a* and 11*b* thin. However, in order to maintain the strength of the device, the thickness of the dielectric skins 11*a* and 11*b* may be decreased only to a certain degree. Therefore, reduction in the weight of the device according to such a method is effective only to a certain extent.

It is to be noted that the flat antenna device as described above may be used in an environment where a significant temperature change is caused. For example, the device may be used in a satellite orbit. In general, the coefficient of thermal expansion of metal members fitted to the grounding conductor sheet or the radiation element sheet differs significantly from that of the other sheets. This produces a problem that, if the antenna device is used in an environment where a significant temperature change occurs, the flatness of the antenna suffers due to bimetal deformation, resulting in deterioration in the electric performance of the antenna device.

Moreover, the metal member used to form the grounding conductor and the radiation element is larger in specific gravity than the material for the other sheets, thus making it even more difficult to reduce the weight of the flat antenna device.

SUMMARY OF THE INVENTION

Accordingly, an object of the present invention is to provide a flat antenna device which is light in weight and has an excellent flatness maintained even in an environment with a significant temperature change such as a satellite orbit.

The aforementioned object can be achieved by a flat antenna device comprising: a radiation element sheet formed such that a metallic radiation element is fitted to one of a film sheet and a meshed sheet; a grounding conductor sheet having a metallic grounding conductor; a frame-like member provided between the radiation element sheet and the grounding conductor sheet; and feeder means for feeding power to the radiation element.

The flat antenna device may further comprise: a mechanism for maintaining the radiation element sheet and the grounding conductor sheet in a fully extended state.

The frame-like member may be formed of a material having a coefficient of thermal expansion different form that of the radiation element sheet and the grounding conductor sheet.

The grounding conductor sheet may be formed by fitting the metallic grounding conductor to the entirety of the surface of one of the film sheet and the meshed sheet.

A plurality of radiation element sheets and a plurality of frame-like members may be built upon one another.

The radiation element sheet and the grounding conductor sheet may be disposed such that the surface carrying the radiation element and the surface carrying the grounding conductor are opposite to each other.

The aforementioned object can also be achieved by a flat antenna device comprising: a radiation element sheet formed such that a metallic radiation element is fitted to one of a film sheet and a meshed sheet; a grounding conductor sheet formed by fitting a metallic grounding conductor having a large number of holes formed therein to one of a film sheet and a meshed sheet; a frame-like member provided between the radiation element sheet and the grounding conductor sheet; a mechanism for maintaining the radiation element sheet and the grounding conductor sheet in a fully extended state; and feeder means for feeding power to the radiation element.

The ground conductor sheet may be formed such that a metallic coat is applied to a meshed sheet.

The grounding conductor sheet may be formed by fitting a compact of metallic fibers to one of a film sheet and a meshed sheet.

The grounding conductor sheet may be formed by fitting knitted metallic fibers to one of a film sheet and a meshed sheet.

The grounding conductor sheet may be formed by embroidering metallic fibers on one of a film sheet and a meshed sheet.

The aforementioned object can also be achieved by a flat antenna device comprising: a radiation element sheet formed by fitting a metallic radiation element having a large number of holes to one of a film sheet and a meshed sheet; a grounding conductor sheet having a metallic grounding conductor; a frame-like member provided between the radiation element sheet and the grounding conductor sheet; and feeder means for feeding power to the radiation element.

The radiation element sheet may be constructed such that a metallic coat is applied to a meshed sheet.

The radiation element sheet may be formed by fitting a compact of metallic fibers to one of a film sheet and a meshed sheet.

The radiation element sheet may be formed by fitting knitted metallic fibers to a film sheet or a meshed sheet.

The radiation element sheet may be formed by embroidering metallic fibers on one of a film sheet and a meshed sheet.

The grounding conductor sheet may be constructed such that a metallic conductor having a large number of holes is fitted to one of a film sheet and a meshed sheet.

BRIEF DESCRIPTIO OF THE DRAWINGS

Other objects and further features of the present invention will be apparent from the following detailed description when read in conjunction with the accompanying drawings, in which:

FIG. 1(*b*) is a sectional view of the antenna device of FIG. 1(*a*);

FIG. 2(*b*) is a sectional view of the antenna device of FIG. 2(*a*);

FIG. 3(*b*) is a sectional view of the antenna device of FIG. 3(*a*);

FIG. 5(*b*) is a sectional view of the antenna device of FIG. 5(*a*);

FIG. 6(*b*) is a sectional view of the antenna device of FIG. 6(*a*);

FIG. 7(*b*) is a sectional view of the antenna device of FIG. 7(*a*);

FIG. 8(*b*) is a sectional view of the antenna device of FIG. 8(*a*);

FIG. 9(*b*) is a sectional view of the antenna device of FIG. 9(*a*);

FIG. 10(*b*) is a sectional view of the antenna device of FIG. 10(*a*)

DETAILED DESCRIPTION OF THE PREFERRED EMBODIMENTS

A description will now be given of the embodiments of the present invention.

The First Embodiment

Figure 1A:
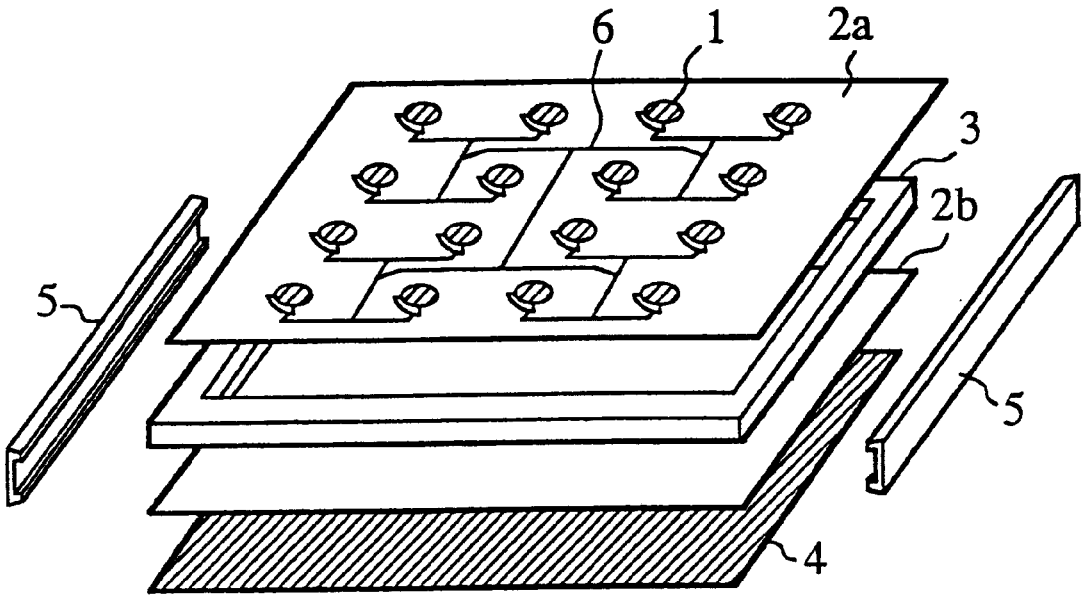
FIG. 1(*a*) is an exploded perspective view showing an overall construction of a flat antenna device according to a first embodiment.
Figure 1B:
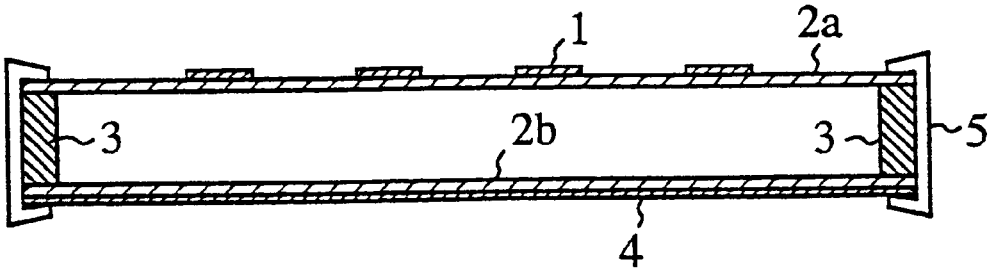

FIG. 1(*a*) is an exploded perspective view showing an overall construction of a flat antenna device according to a first embodiment, and FIG. 1(*b*) is a sectional view of the antenna device of FIG. 1(*a*). Referring to FIGS. 1(*a*) and 1(*b*), reference numeral 1 indicates a metallic radiation element configured as, for example, a circular patch. Numerals 2*a* and 2*b* indicate thin dielectric films (sheet) formed of, for example, Kevlar fiber reinforced plastic (KFRP). Numeral 3 indicates a dielectric member of a picture frame configuration (picture frame member) formed of, for example, carbon fiber reinforced plastic (CFRP). Numeral 4 indicates a thin metallic grounding conductor film (grounding conductor), numeral 5 indicates an extending mechanism (mechanism for maintaining the dielectric films in a fully extended state) and feeder numeral 6 indicates means for feeding power to the circular patches 1. The feeder means may be embodied, for instance, by microstrip lines. As shown in FIGS. 1(*a*) and 1(*b*), the circular patches 1 and the metallic grounding conductor film 4 are fitted to the dielectric films 2*a* and 2*b*, respectively, so as to constitute the radiation element sheet and the grounding conductor sheet, respectively. The dielectric films 2*a* and 2*b* are built upon one another so as to sandwich the dielectric picture frame member 3 therebetween. The extending mechanism 5 is fitted to the periphery of the construction so as to maintain the dielectric films 2*a* and 2*b* in a fully extended state. Therefore, a circular microstrip patch antenna is constructed of the metallic grounding conductor film 4 and the circular patch 1.

In the flat antenna device constructed as described above, an excellent flatness is produced because the dielectric films 2*a* and 2*b* are maintained in a fully extended state by the extending mechanism 5. Moreover, since a dielectric material does not fill the entirety of the space between the circular patch 1 and the metallic grounding conductor film 4 constituting a circular microstrip patch antenna, a broadband, low-loss flat antenna device with a light weight is obtained. A notable benefit resulting from this is that the weight of a large-scale antenna is significantly reduced as compared with the prior-art antenna.

The Second Embodiment

Figure 2A:
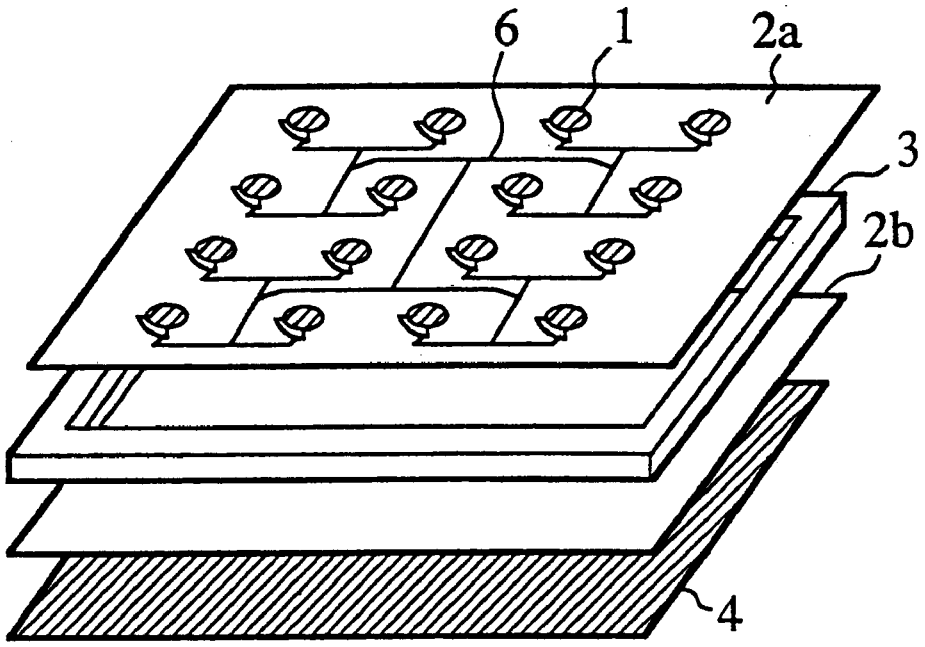
FIG. 2(*a*) is an exploded perspective view showing an overall construction of a flat antenna device according to a second embodiment.
Figure 2B:
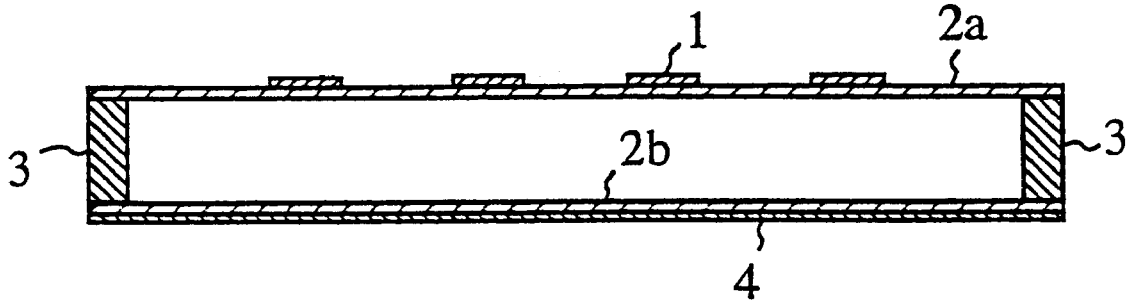

FIGS. 2(*a*) and 2(*b*) show a construction of a flat antenna device according to a second embodiment of the present invention. FIG. 2(*a*) is an exploded perspective view showing an overall construction of the device, and FIG. 2(*b*) is a sectional view thereof. As shown in FIGS. 2(*a*) and 2(*b*), the circular patches 1 and the metallic grounding conductor film 4 are fitted to the KFRP dielectric films 2*a* and 2*b*, respectively, so as to constitute the radiation element sheet and the grounding conductor sheet, respectively. In the second embodiment, the dielectric films 2*a* and 2*b* sandwich the dielectric member 3 such that the dielectric films 2*a* and 2*b* are adhesively attached to the dielectric member 3 in a high-temperature environment. Thus, a circular microstrip patch antenna is constructed of the metallic grounding conductor film 4 and the circular patch 1.

Since the coefficient of thermal expansion of the KFRP dielectric films 2*a* and 2*b* of the flat antenna device constructed as described above is positive while the coefficient of thermal expansion of the CFRP dielectric member 3 thereof is negative, the dielectric films 2*a* and 2*b* are maintained in a fully extended state in a temperature lower than the temperature when the adhesion is performed. Thus, an antenna device with an excellent flatness results. Since no specific mechanism for maintaining the dielectric films 2*a* and 2*b* in a fully extended state is introduced, it is easier to produce a flat antenna device according to the second embodiment than according to the first embodiment.

Further, the weight of the device is further reduced according to the second embodiment. Moreover, since a dielectric material does not fill the entirety of the space between the circular patch 1 and the metallic grounding conductor film 4 constructing a circular microstrip patch antenna, a broadband, low-loss flat antenna device with a light weight is obtained. A notable benefit resulting form this is that the weight of a large-scale antenna is significantly reduced as compared with the prior-art antenna.

The Third Embodiment

Figure 3A:
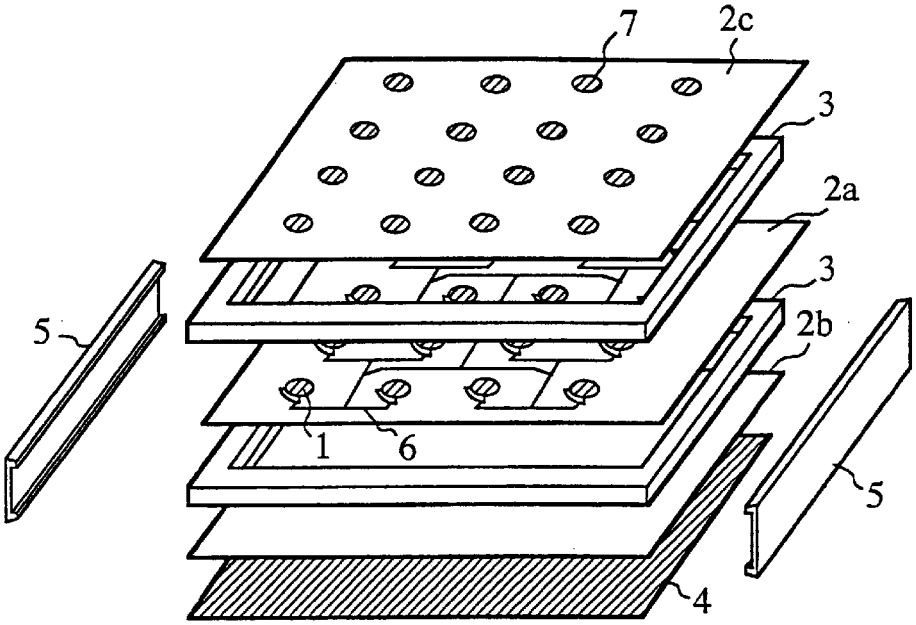
FIG. 3(*a*) is an exploded perspective view showing an overall construction of a flat antenna device according to a third embodiment.
Figure 3B:
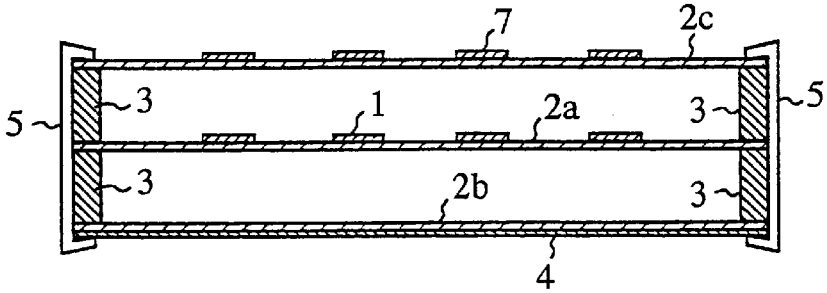

FIGS. 3(*a*) and 3(*b*) show a construction of a flat antenna device according to a third embodiment of the present invention. FIG. 3(*a*) is an exploded perspective view of the entirety of the device, and FIG. 3(*b*) is a sectional view thereof. The device according to the third embodiment is an elaboration of the device according to the first embodiment or the device according to the second embodiment. Here, a description is given of the device which is an elaboration of the device of the first embodiment. Referring to FIGS. 3(*a*) and 3(*b*), reference numeral 7 indicates a metallic radiation element. In this embodiment, the radiation elements 7 are formed as parasitic circular patches. Numeral 2*c* indicates a KFRP sheet to which the parasitic circular patches are fitted. In this embodiment, the dielectric member 3 is inserted between the dielectric film 2*a* and the dielectric film 2*b*, and also between the dielectric film 2*a* and the dielectric film 2*c*. The extending mechanism 5 is fitted to the periphery of the construction so as to maintain the dielectric film 2*a*, the dielectric film 2*b* and the dielectric film 2*c* in a fully extended state. Thus, a circular microstrip patch antenna provided with a parasitic element is constructed of the metallic grounding conductor film 4, the circular patch 1 and the parasitic circular patch 7.

In the flat antenna device constructed as described above, an excellent flatness is produced since the dielectric films 2*a*, 2*b* and 2*c* are maintained in a fully extended state by the extending mechanism 5. Moreover, since a dielectric material does not fill the entirety of the space between the parasitic circular patch 7 and the circular patch 1 and also between the circular patch 1 and the metallic grounding conductor film 4, a broadband, low-loss flat antenna device with a light weight is obtained. A notable benefit resulting from this is that the weight of a large-scale antenna is significantly reduced as compared with the prior-art antenna.

The Fourth Embodiment

Figure 4:
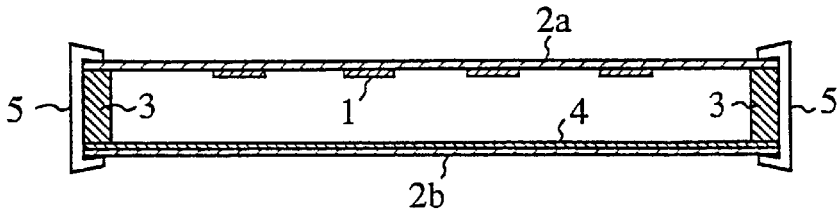
FIG. 4 shows a construction of a flat antenna device according to a fourth embodiment of the present invention.

FIG. 4 shows a construction of a flat antenna device according to a fourth embodiment of the present invention. The device according to the fourth embodiment is an elaboration of the device according to the first embodiment, the device according to the second embodiment or the device according to the third embodiment. FIG. 4 is a sectional view of the device which is an elaboration of the device of the first embodiment. As shown in FIG. 4, in the fourth embodiment, the surface of the dielectric film 2*a* carrying the circular patches 1 and the surface of the dielectric film 2*b* carrying the metallic grounding conductor film 4 are disposed so as to be opposite to each other.

In the flat antenna device constructed as described above, a dielectric material does not fill the space between the circular patch 1 and the metallic grounding conductor film 4. That is, a dielectric material is absent in a space with a high concentration of electric field. In this way, an improved broadband, low-loss flat antenna device is obtained.

The Fifth Embodiment

Figure 5A:
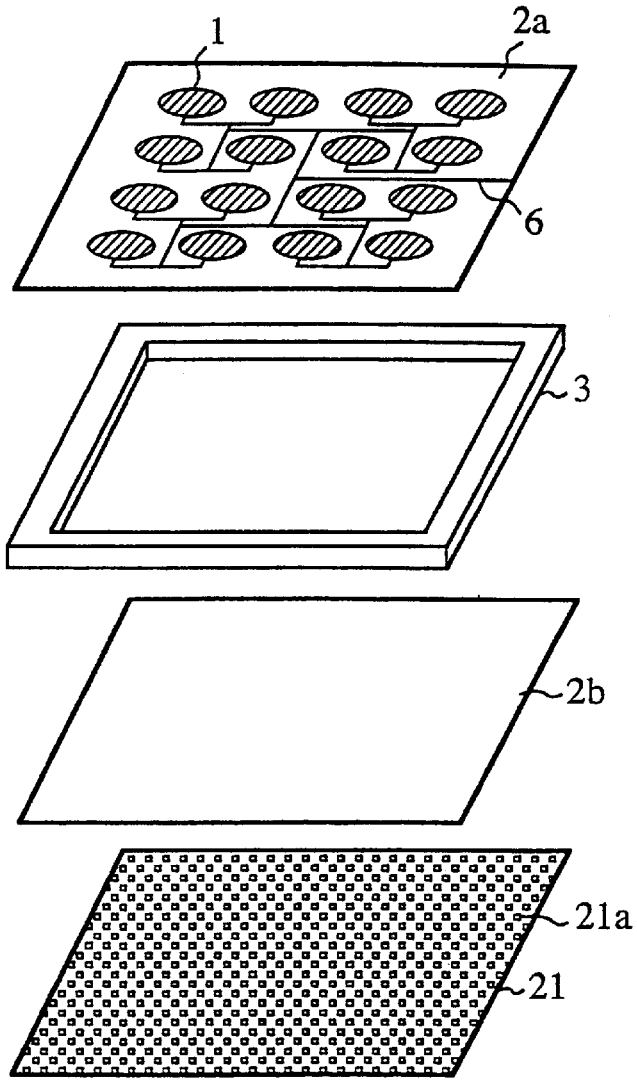
FIG. 5(*a*) is an exploded perspective view showing an overall construction of a flat antenna device according to a fifth embodiment.
Figure 5B:
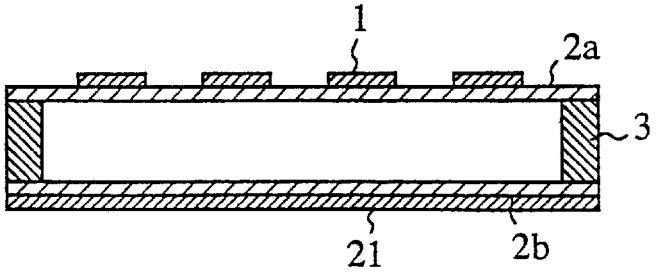

FIGS. 5(*a*) and 5(*b*) show a construction of a flat antenna device according to a fifth embodiment of the present invention. FIG. 5(*a*) is an exploded perspective view of the overall construction of the device, and FIG. 5(*b*) is a sectional view thereof. Referring to FIGS. 5(*a*) and 5(*b*), reference numeral 1 indicates a metallic radiation element configured as, for example, a circular patch. Numeral 2*a* indicates a film dielectric sheet or a meshed dielectric sheet, and numeral 2*b* also indicates a film dielectric sheet or a meshed dielectric sheet. For example, each of the dielectric sheets 2*a* and 2*b* may be formed of KFRP (Kevlar fiber reinforced plastic). Numeral 3 indicates a dielectric member configured as a picture frame and formed of, for instance, CFRP (carbon fiber reinforced plastic). Numeral 21 indicates a metallic grounding conductor in which a large number of holes 21*a* are formed. For example, the holes may be formed by etching a copper foil (hereafter, grounding conductor 21 will be referred to as a perforated copper foil). Numeral 6 indicates feeder means for feeding power to the circular patches 1. The feeder means may be formed of, for instance, by microstrip lines. As shown in FIGS. 5(*a*) and 5(*b*), the circular patches 1 and the perforated copper foil 21 are fitted on the dielectric film 2*a* and the dielectric film 2*b*, respectively, so as to constitute the radiation element sheet and the grounding conductor sheet, respectively. The dielectric film 2*a* and the dielectric film 2*b* are built upon one another and adhesively attached to each other so as to sandwich the dielectric member 3 therebetween. Thus, a circular microstrip patch antenna is constructed of the perforated copper foil 21 and the circular patch 1.

In the flat antenna device constructed as described above, since a large number of holes 21*a* exist in the perforated copper foil 21 operating as a grounding conductor, the modulus of elasticity of the surface of the copper foil 21 is relatively low so that thermal stress generated in the grounding conductor sheet when a surrounding temperature changes is eased. An effect obtained as a result of this is that deterioration in the antenna performance due to bimetal deformation and occurring in a prior-art expansion flat antenna having a metallic film fitted to the entirety of the surface of the grounding conductor sheet is prevented, even when the antenna device is placed in a harsh temperature environment like a satellite orbit.

Moreover, as compared with the device with a continuous metallic film, the gross weight of metal is decreased by using a metallic member having a large number of holes formed therein as a grounding conductor. This provides an effect of reducing the weight of the flat antenna device.

The Sixth Embodiment

Figure 6A:
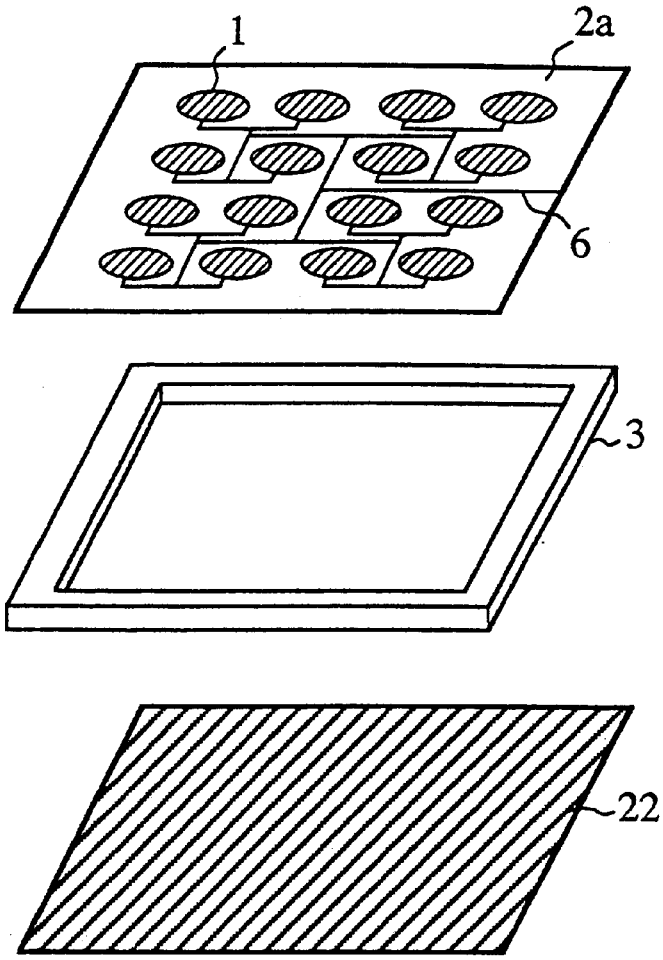
FIG. 6(*a*) is an exploded perspective view showing an overall construction of a flat antenna device according to a sixth embodiment.
Figure 6B:
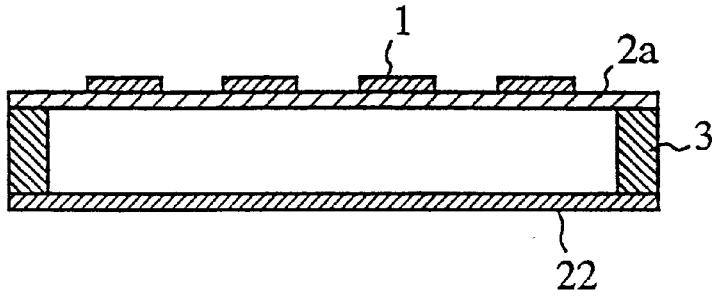

FIGS. 6(*a*) and 6(*b*) show a construction of a flat antenna device according to a sixth embodiment of the present invention. FIG. 6(*a*) is an exploded perspective view of the overall construction of the device, and FIG. 6(*b*) is a sectional view thereof. Referring to FIGS. 6(*a*) and 6(*b*), numeral 22 indicates a grounding conductor sheet constructed such that a metallic coat is applied to a meshed dielectric sheet. For example, copper may be plated to a KFRP sheet reinforced by a coarse tri-axis Kevlar fabric to form the grounding conductor sheet 22.

The flat antenna device of this construction is the same as the device according to the fifth embodiment except that the meshed KFRP sheet having the copper plate applied thereto is used as the grounding conductor sheet 22 instead of the perforated copper foil 21 fitted to the KFRP dielectric film 2*b*. In FIGS. 6(*a*) and 6(*b*), those components that correspond to the components of the device according to the fifth embodiment are designated by the same reference numerals and the description thereof is omitted.

Since the copper plating operating as the grounding conductor is integrated with the KFRP tri-axis fabric in the flat antenna device constructed as described above, the unfavorable effect due to bimetal deformation is prevented. Moreover, thermal stress generated in the grounding conductor sheet when a surrounding temperature changes is eased because the copper plating on the tri-axis fabric KFRP has a meshed distribution. An effect obtained as a result of this is that deterioration in the antenna performance due to bimetal deformation and occurring in a prior-art expansion flat antenna having a metallic film fitted to the entirety of the surface of the grounding conductor sheet is prevented, even when the antenna device is placed in a harsh temperature environment like a satellite orbit.

Moreover, as compared with the device with a metallic film fitted to the entirety of the KFRP sheet, the copper plating on the KFRP tri-axis fabric causes the gross weight of metal to decrease. This provides an effect of reducing the weight of the flat antenna device.

The Seventh Embodiment

The flat antenna device according to a seventh embodiment of the present invention is the same as the device according to the fifth embodiment except that a compact formed of metallic fibers is used as the grounding conductor instead of the perforated copper foil 21. In the seventh embodiment, short fibers of copper may be thinned like paper so as to form a tissue-like compact.

In the flat antenna device constructed as described above, the modulus of elasticity of the surface of the copper ground conductor is relatively low as in the device according to the fifth embodiment so that thermal stress generated in the grounding conductor sheet occurring when a surrounding temperature changes is eased. Thus, deterioration in the antenna performance due to bimetal deformation is prevented.

Moreover, as compared with the device with a metallic film, the gross weight of metal is decreased by using the metallic-fiber compact as a grounding conductor. This provides an effect of reducing the weight of the flat antenna device.

The Eighth Embodiment

The flat antenna device according to an eighth embodiment of the present invention is the same as the device according to the fifth embodiment except that a compact formed of metallic fibers is used as the grounding conductor instead of the perforated copper foil 21. In the eighth embodiment, the compact is formed by twining long fibers of copper around each other.

In the flat antenna device constructed as described above, the modulus of elasticity of the surface of the copper ground conductor is relatively low as in the device according to the fifth embodiment so that thermal stress generated in the grounding conductor sheet occurring when a surrounding temperature changes is eased. Thus, deterioration in the antenna performance due to bimetal deformation is prevented.

Moreover, as compared with the device with a metallic film, the gross weight of metal is decreased by using the metallic-fiber compact as a grounding conductor. This provides an effect of reducing the weight of the flat antenna device.

The Ninth Embodiment

The flat antenna device according to a ninth embodiment of the present invention is the same as the device according to the fifth embodiment except that a compact formed of metallic fibers is used as the grounding conductor instead of the perforated copper foil 21. In the ninth embodiment, the compact is formed by tricot-knitting long fibers of copper.

In the flat antenna device constructed as described above, the modulus of elasticity of the surface of the copper grounding conductor is relatively low as in the device according to the fifth embodiment so that thermal stress generated in the grounding conductor sheet occurring when a surrounding temperature changes is eased. Thus, deterioration in the antenna performance due to bimetal deformation is prevented.

Moreover, as compared with the device with a metallic film, the gross weight of metal is decreased by using the metallic-fiber compact as a grounding conductor. This provides an effect of reducing the weight of the flat antenna device.

The Tenth Embodiment

Figure 7A:
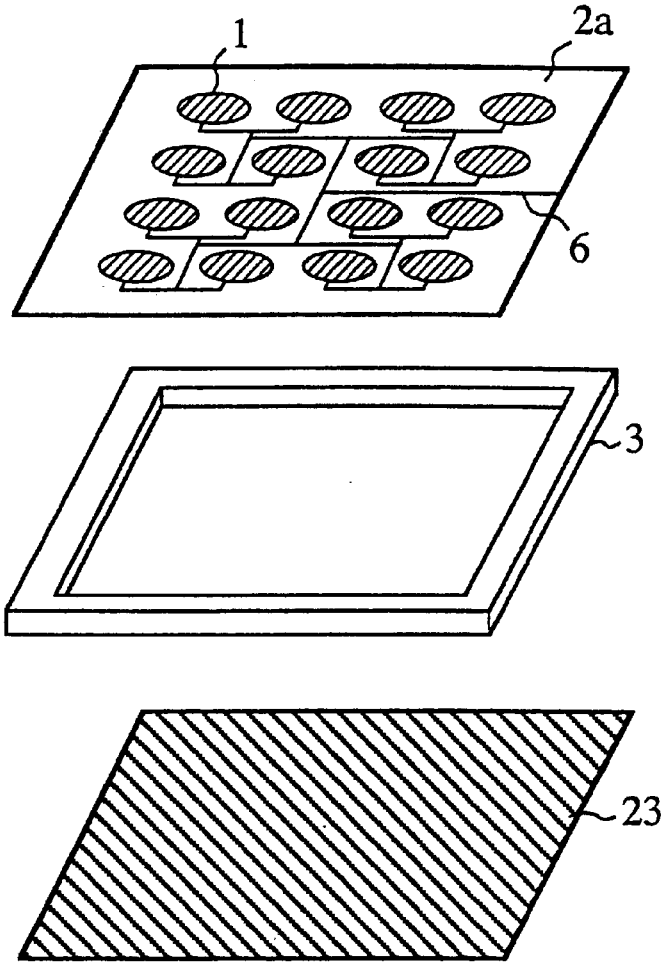
FIG. 7(*a*) is an exploded perspective view showing an overall construction of a flat antenna device according to a tenth embodiment.
Figure 7B:
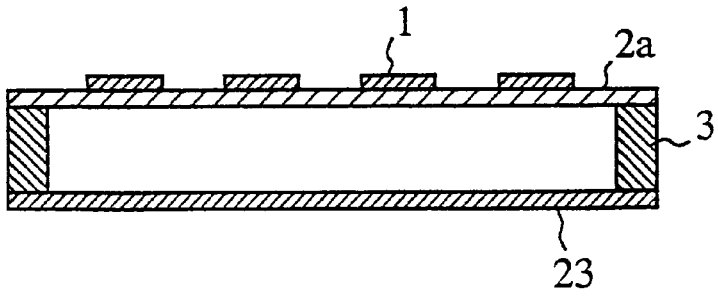

FIGS. 7(*a*) and 7(*b*) show a construction of a flat antenna device according to a tenth embodiment of the present invention. FIG. 7(*a*) is an exploded perspective view of the overall construction of the device, and FIG. 7(*b*) is a sectional view thereof. Referring to FIGS. 7(*a*) and 7(*b*), reference numeral 23 indicates a grounding conductor sheet formed by embroidering metallic fibers on a dielectric sheet formed as a mesh or a film. In the tenth embodiment, copper fibers are embroidered on a KFRP tri-axis fabric.

The flat antenna device according to the tenth embodiment is the same as the device according to the fifth embodiment except that the KFRP tri-axis fabric having the copper fibers embroidered thereon is used as the grounding conductor sheet 23 instead of the perforated copper foil 21 fitted to the dielectric film 2*b*. In FIGS. 7(*a*) and 7(*b*), those components that correspond to the components of the device according to the fifth embodiment are designated by the same reference numerals and the description thereof is omitted.

In the flat antenna device constructed as described above, the copper fibers embroidered on the grounding conductor sheet are formed as meshes not interfering one another so that thermal stress generated in the grounding conductor sheet occurring when a surrounding temperature changes is eased. An effect obtained as a result of this is that deterioration in the antenna performance due to bimetal deformation and occurring in a prior-art expansion flat antenna having a metallic film fitted to the entirety of the surface of the grounding conductor sheet is prevented, even when the antenna device is placed in a harsh temperature environment like a satellite orbit.

By embroidering metallic fibers on the grounding conductor sheet, the gross weight of metal is decreased as compared to the device where a metallic film is fitted to the grounding conductor. This provides an effect of reducing the weight of the flat antenna device.

The Eleventh Embodiment

Figure 8A:
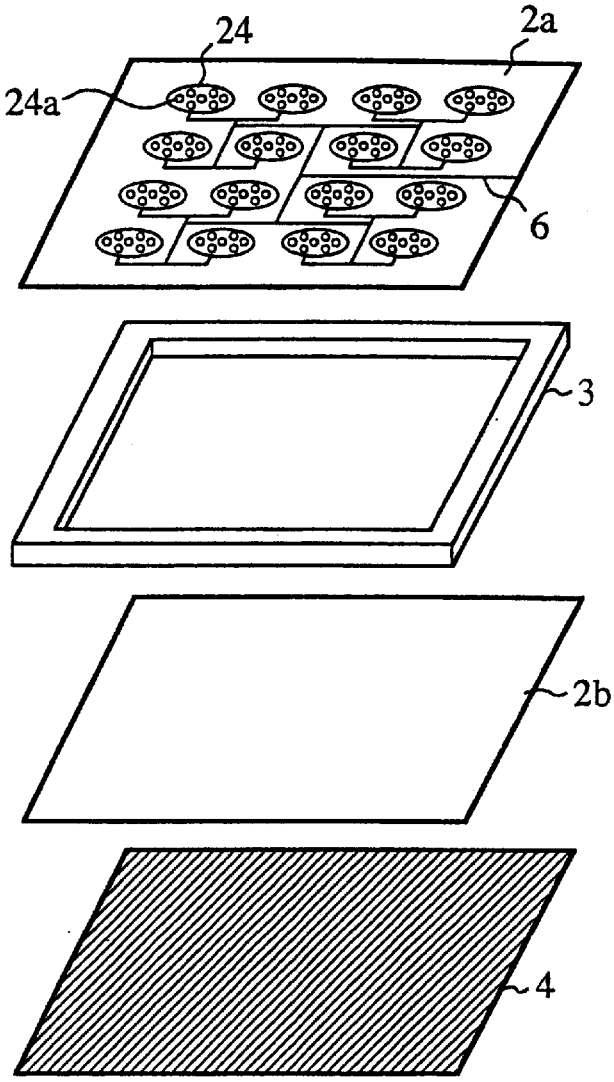
FIG. 8(*a*) is an exploded perspective view showing an overall construction of a flat antenna device according to an eleventh embodiment.
Figure 8B:
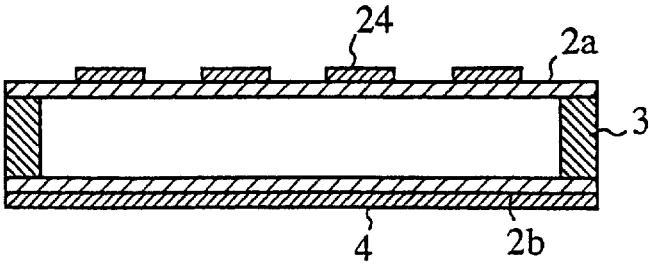

FIGS. 8(*a*) and (*b*) show a construction of a flat antenna device according to an eleventh embodiment of the present invention. FIG. 8(*a*) is an exploded perspective view of the overall construction of the device, and FIG. 8(*b*) is a sectional view thereof. Referring to FIGS. 8(*a*) and 8(*b*), reference numeral 24 indicates a metallic radiation element having a large number of holes formed therein. In this embodiment, each of the radiation elements 24 is formed as a circular patch formed by etching a circular copper foil so as to form holes 24*a*. Numeral 2*a* indicates a film dielectric sheet or a meshed dielectric sheet, and numeral 2*b* also indicates a film dielectric sheet or a meshed dielectric sheet. For example, the dielectric films 2*a* and 2*b* may be formed of, for example, KFRP. Numeral 3 indicates a dielectric member configured as a picture frame and formed of, for instance, CFRP (carbon fiber reinforced plastic). Numeral 4 indicates a metallic grounding conductor metallic film embodied by, for example, a copper foil. Numeral 6 indicates feeder means for feeding power to the circular patches 24. The feeder means 6 may be embodied by, for instance, microstrip lines. As shown in FIGS. 8(*a*) and 8(*b*), the circular patches 24 and the metallic grounding conductor film 4 are fitted to the dielectric film 2*a* and the dielectric film 2*b*, respectively, so as to constitute the radiation element sheet and the ground conductor sheet, respectively. The dielectric film 2*a* and the dielectric film 2*b* are built upon one another and adhesively attached to each other so as to sandwich the dielectric member 3 therebetween. Thus, a circular microstrip patch antenna is constructed of the metallic grounding conductor film 4 and the circular patch 24.

In the flat antenna device constructed as described above, since a large number of holes exist in the copper foil operating as the radiation element, the modulus of elasticity of the surface of the copper foil is relatively low so that thermal stress generated in the grounding conductor sheet when a surrounding temperature changes is eased. An effect obtained as a result of this is that deterioration in the antenna performance due to bimetal deformation and occurring in a prior-art expansion flat antenna having a metallic film fitted to the radiation element sheet is prevented, even when the antenna device is placed in a harsh temperature environment like a satellite orbit.

Moreover, as compared with the device with a continuous metallic film, the gross weight of metal is decreased by using the copper foil having a large number of holes formed therein as a radiation element. This provides an effect of reducing the weight of the flat antenna device.

The Twelfth Embodiment

Figure 9A:
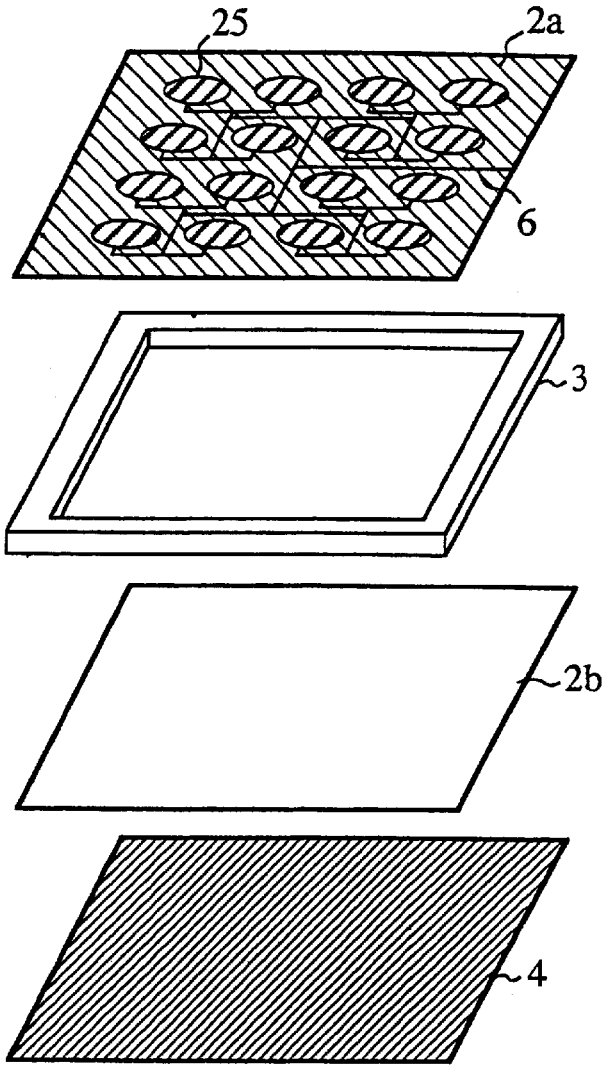
FIG. 9(*a*) is an exploded perspective view showing an overall construction of a flat antenna device according to a twelfth embodiment.
Figure 9B:
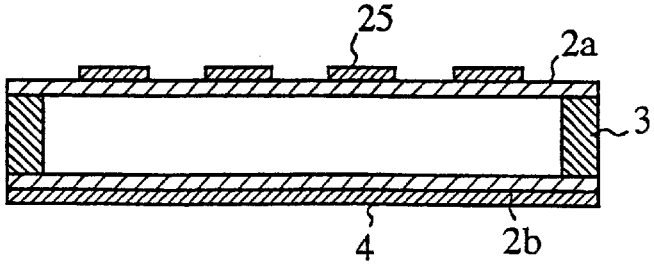

FIGS. 9(*a*) and (*b*) show a construction of a flat antenna device according to a twelfth embodiment of the present invention. FIG. 9(*a*) is an exploded perspective view of the overall construction of the device, and FIG. 9(*b*) is a sectional view thereof. Referring to FIGS. 9(*a*) and 9(*b*), reference numeral 2*a* indicates a meshed dielectric sheet. In the twelfth embodiment, the meshed dielectric sheet 2*a* is formed of KFRP reinforced by a coarse tri-axis Kevlar fabric. Numeral 25 indicates a metallic radiation element coated on the meshed dielectric sheet. In this embodiment, the radiation element is formed as a circular patch formed by applying a copper plate of a circular pattern on the tri-axis dielectric fabric film 2*a*.

The flat antenna device according to the twelfth embodiment is the same as the device according to the eleventh embodiment except that the tri-axis fabric dielectric film 2*a* having the copper plate of a circular pattern applied thereto is used as the radiation element sheet instead of the perforated copper foil 21 fitted to the dielectric film 2*a*. In FIGS. 9(*a*) and 9(*b*), those components that correspond to the components of the device according to the eleventh embodiment are designated by the same reference numerals and the description thereof is omitted.

Since the copper plate operating as a radiation element is integrated with the tri-axis KFRP fabric dielectric sheet 2*a* in the flat antenna device constructed as described above, the unfavorable effect due to bimetal deformation is prevented. Moreover, thermal stress generated in the grounding conductor sheet when a surrounding temperature changes is eased since the copper plated on the KFRP tri-axis fabric has a meshed distribution. An effect obtained as a result of this is that deterioration in the antenna performance due to bimetal deformation and occurring in a prior-art expansion flat antenna having a metallic film fitted to the radiation element sheet is prevented, even when the antenna device is placed in a harsh temperature environment like a satellite orbit.

Moreover, as compared with the device with a metallic film fitted to the dielectric film, the gross weight of metal is decreased by plating copper on the tri-axis KFRP fabric dielectric film 2*a* to construct the radiation element sheet. This provides an effect of reducing the weight of the flat antenna device.

The Thirteenth Embodiment

The flat antenna device according to a thirteenth embodiment of the present invention is the same as the device according to the eleventh embodiment except that the circular patch is formed by a metallic fiber compact instead of the perforated copper foil 21. In the thirteenth embodiment, short fibers of copper may be thinned like paper so as to form a tissue-like compact.

In the flat antenna device constructed as described above, the modulus of elasticity of the surface of the copper radiation element is relatively low as in the eleventh embodiment so that thermal stress generated in the radiation element sheet when a surrounding temperature changes is eased. Thus, deterioration in the antenna performance due to bimetal deformation is prevented.

Moreover, as compared with the device with a metallic film, the gross weight of metal is decreased by using the metallic-fiber compact as a radiation element. This provides an effect of reducing the weight of the flat antenna device.

The Fourteenth Embodiment

The flat antenna device according to a fourteenth embodiment of the present invention is the same as the device according to the eleventh embodiment except that a compact formed of metallic fibers is used to form the circular patch instead of the perforated copper foil 21. In the fourteenth embodiment, the compact is formed by twining long fibers of copper around each other.

In the flat antenna device constructed as described above, the modulus of elasticity of the surface of the copper radiation element is relatively low as in the device according to the eleventh embodiment so that thermal stress generated in the radiation element sheet occurring when a surrounding temperature changes is eased. Thus, deterioration in the antenna performance due to bimetal deformation is prevented.

Moreover, as compared with the device with a metallic film, the gross weight of metal is decreased by using the metallic-fiber compact as a radiation element. This provides an effect of reducing the weight of the flat antenna device.

The Fifteenth Embodiment

The flat antenna device according to a fifteenth embodiment of the present invention is the same as the device according to the eleventh embodiment except that the circular patch is formed by a compact formed of metallic fibers instead of the perforated copper foil 21. In the fifteenth embodiment, the compact is formed by tricot-knitting long fibers of copper.

In the flat antenna device constructed as described above, the modulus of elasticity of the surface of the copper radiation element is relatively low as in the device according to the eleventh embodiment so that thermal stress generated in the radiation element sheet occurring when a surrounding temperature changes is eased. Thus, deterioration in the antenna performance due to bimetal deformation is prevented.

Moreover, as compared with the device with a metallic film, the gross weight of metal is decreased by using the metallic-fiber compact as a radiation element. This provides an effect of reducing the weight of the flat antenna device.

The Sixteenth Embodiment

Figure 10A:
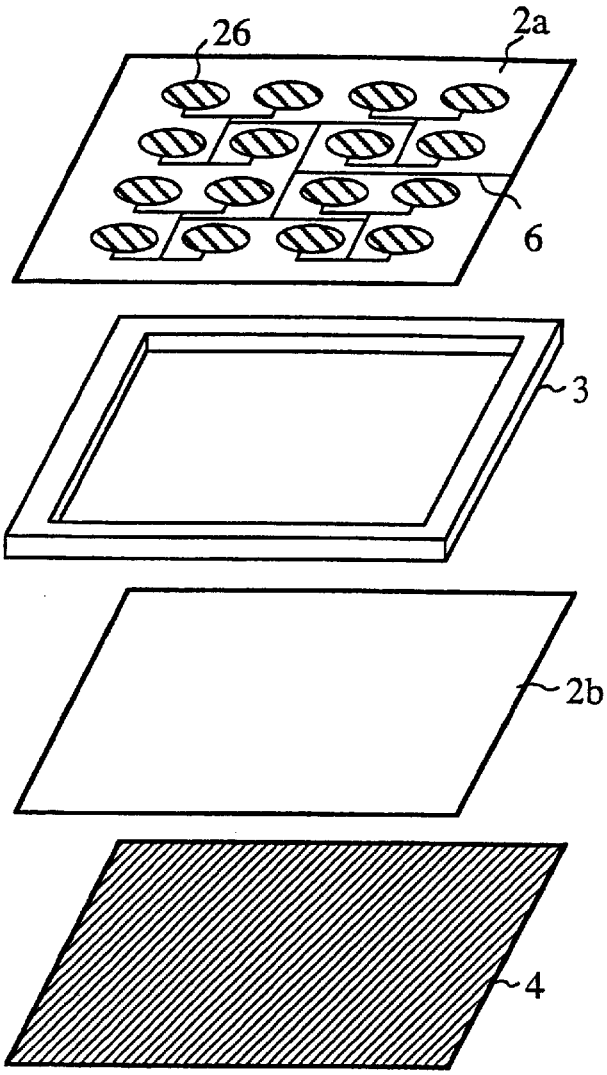
FIG. 10(*a*) is an exploded perspective view showing an overall construction of a flat antenna device according to a sixteenth embodiment.
Figure 10B:
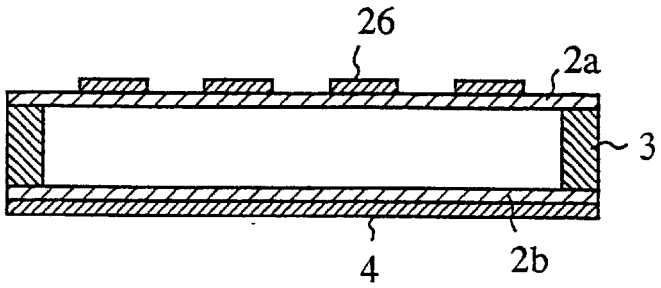
Figure 11:
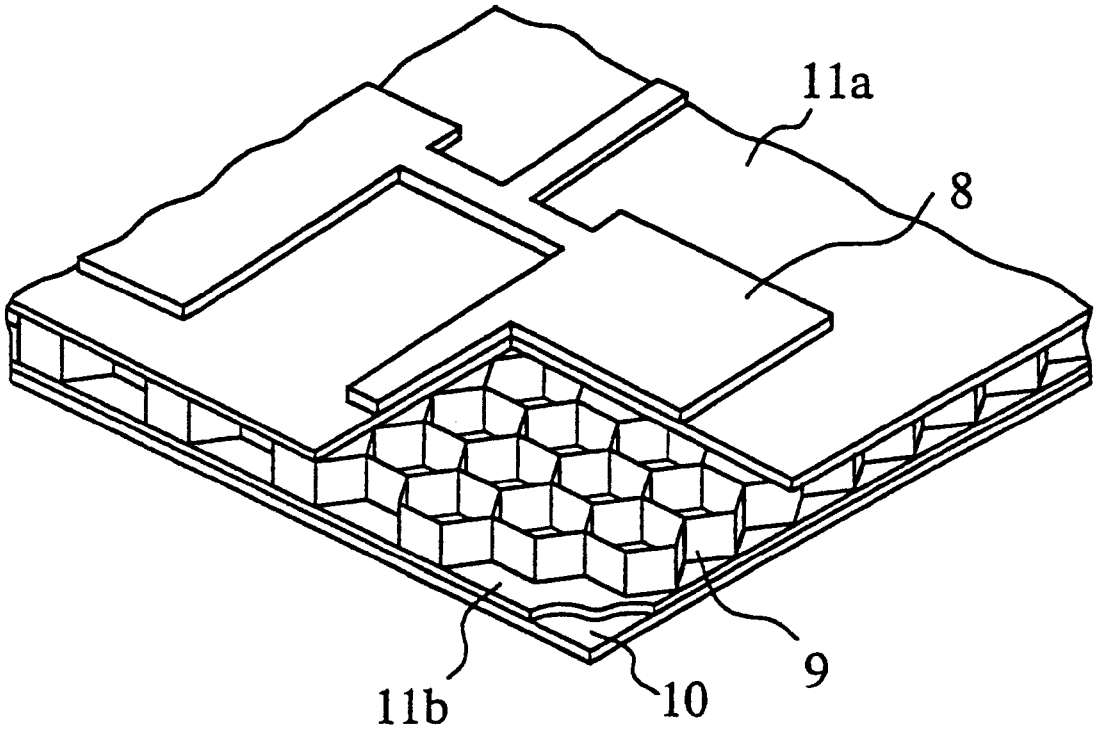
FIG. 11 shows a flat antenna device according to a prior art.

FIGS. 10(*a*) and 10(*b*) show a construction of a flat antenna device according to a sixteenth embodiment of the present invention. FIG. 10(*a*) is an exploded perspective view of the overall construction of the device, and FIG. 10(*b*) is a sectional view thereof. Referring to FIGS. 10(*a*) and 10(*b*), reference numeral 2*a* indicates a dielectric sheet formed as a mesh or a film. In the sixteenth embodiment, the dielectric sheet is embodied by a Kevlar tri-axis fabric. Numeral 26 indicates a radiation element formed by embroidering metallic fibers on the dielectric sheet 2*a*. In this embodiment, the radiation element is formed as a circular patch formed by embroidering copper fibers on the KFRP tri-axis fabric in a circular pattern.

The flat antenna device according to the sixteenth embodiment is the same as the device according to the eleventh embodiment except that the KFRP tri-axis fabric having the copper fibers embroidered thereon is used as the radiation element sheet instead of the perforated copper foil 21 fitted to the dielectric film 2*a*. In FIGS. 10(*a*) and 10(*b*), those components that correspond to the components of the device according to the eleventh embodiment are designated by the same reference numerals and the description thereof is omitted.

In the flat antenna device constructed as described above, the copper fibers embroidered on the radiation element sheet are formed as meshes not interfering each other so that thermal stress generated in the radiation element sheet occurring when a surrounding temperature changes is eased. An effect obtained as a result of this is that deterioration in the antenna performance due to bimetal deformation and occurring in a prior-art expansion flat antenna having a metallic film fitted to the radiation element sheet is prevented, even when the antenna device is placed in a harsh temperature environment like a satellite orbit.

By embroidering metallic fibers on the radiation element sheet, the gross weight of metal is decreased as compared with the device having a metallic film fitted to the radiation element. This provides an effect of reducing the weight of the flat antenna device.

The Seventeenth Embodiment

The flat antenna device according to a seventeenth embodiment is the same as the device according to the fifth embodiment except that the grounding conductor sheet according to any of the fifth through tenth embodiments is used and the radiation element sheet according to any of the eleventh through sixteenth embodiments is used.

In the flat antenna device constructed as above, deterioration in the antenna performance due to bimetal deformation is prevented even more successfully by implementing the grounding conductor sheet and the radiation element sheet using metal members having a large number of holes formed therein. This provides an effect of further reducing the weight of the flat antenna device.

The description given above of the specific embodiments is not to be construed as exhaustive. The following variations of the flat antenna device according to the present invention are conceivable.

In the first through seventeenth embodiments described above, the dielectric film is formed of KFRP, the dielectric member of a picture frame configuration is formed of CFRP, and the meshed dielectric fabric is formed of a Kevlar fabric. However, these members may also be formed of other dielectric materials. In the first through fourth embodiments, the metallic film forming the grounding conductor may not be fitted to the dielectric sheet. The ground conductor sheet may also be formed only of the metallic film. This provides a benefit of reducing the weight of the flat antenna device thanks to the absence of the dielectric sheet.

In the first through seventeenth embodiments, the microstrip lines are used to feed power to the circular patches 1, 24, 25 and 26. However, power may also be fed to the circular patches via pins provided at the back of the antenna.

In the first through seventeenth embodiments, the radiation element is embodied by the circular patches 1, 24, 25 and 26. However, a square patch or a printed dipole may also be used to implement the radiation element.

Further, the construction according to the first through fourth embodiments and the construction according to the fifth through seventeenth embodiments may be combined. That is, a metallic member having holes formed therein may be used as a grounding conductor or a radiation element in a flat antenna device provided with the extending mechanism. Alternatively, a metallic member having holes formed therein may be used as a grounding conductor or a radiation element in a flat antenna device in which the coefficient of thermal expansion of the sheets is controlled. Accordingly, a flat antenna device in which an excellent flatness is maintained in an environment with a significant change in the temperature is obtained.

To summarize, the following benefits are available in the flat antenna device according to the present invention.

In accordance with the invention, a flat antenna device comprises a radiation element sheet formed such that metallic radiation elements are fitted to a film sheet or meshed sheet, a grounding conductor sheet having a metallic grounding conductor, a frame-like member provided between the radiation element sheet and the grounding conductor sheet, a mechanism for maintaining the radiation element sheet and the grounding conductor sheet in a fully extended state, and feeder means for feeding power to the radiation elements. Thus, a light-weight, low-loss, broadband flat antenna device is obtained.

In further accordance with the invention, a flat antenna device comprises a radiation element sheet formed such that metallic radiation elements are fitted to a film sheet or meshed sheet, a grounding conductor sheet having a metallic grounding conductor, a frame-like member provided between the radiation element sheet and the grounding conductor sheet and formed of a material having a coefficient of thermal expansion different from that of the radiation element sheet and the grounding conductor sheet, and feeder means for feeding power to the radiation elements. Accordingly, a light-weight, low-loss, broadband flat antenna device in which an excellent flatness is maintained without resorting to an extending mechanism is obtained.

In further accordance with the invention, the grounding conductor sheet is constructed such that a metallic grounding conductor is fitted to the entirety of the surface of the film sheet or the meshed sheet. Thus, the mechanical strength of the grounding conductor sheet is increased. In a construction in which an extending mechanism is used, this provides an effect of maintaining the grounding conductor sheet and the radiation element sheet in a fully extended state more properly so that the flatness of the flat antenna device is improved. In a construction in which the coefficient of thermal expansion of the sheet is controlled, the coefficient of thermal expansion of the grounding conductor sheet is controlled by selecting a material constructing the sheet. Therefore, a desired coefficient is easily obtained so that the flatness of the flat antenna device is improved.

In further accordance with the invention, a plurality of radiation element sheets and a plurality of picture-frame members are built upon one another so that a light-weight, low-loss, broadband flat antenna device is obtained.

In further accordance with the invention, the radiation element sheet and the grounding conductor sheet are disposed such that the surface carrying metallic members operating as radiation elements and the surface carrying the metallic member operating as a grounding conductor are opposite to each other. Thus, a flat, light-weight, low-loss, broadband antenna device is obtained.

In further accordance with the invention, a flat antenna device comprises a radiation element sheet formed by fitting metallic radiation elements to a film sheet or a meshed sheet, a grounding conductor sheet formed by fitting a metallic grounding conductor having a large number of holes formed therein to a film sheet or a meshed sheet, a picture-frame member provided between the radiation element sheet and the grounding conductor sheet, and feeder means for feeding power to the radiation elements. Accordingly, the modulus of elasticity of the surface of the grounding conductor is relatively low so that thermal stress generated due to a change in the surrounding temperature is eased and deterioration in the antenna performance due to thermal deformation is prevented. Further, the gross weight of metal used to construct the grounding conductor is reduced so that the weight of the flat antenna device reduced.

In further accordance with the invention, the grounding conductor sheet is constructed such that a metallic coat is applied to a meshed sheet so that the grounding conductor has a meshed distribution. Accordingly, thermal stress generated due to a change in the surrounding temperature is eased so that deterioration in the antenna performance due to thermal deformation is prevented. Further, the gross weight of metal used to construct grounding conductor is reduced so that a light-weight flat antenna device is obtained.

In further accordance with the invention, the grounding conductor sheet is formed by fitting a compact of metallic fibers to a film sheet or a meshed sheet. Accordingly, the modulus of elasticity of the surface of the grounding conductor is relatively low so that thermal stress generated due to a change in the surrounding temperature is eased and deterioration in the antenna performance due to thermal deformation is prevented. Further, the gross weight of metal used to construct the grounding conductor is reduced so that the weight of the flat antenna device is reduced.

In further accordance with the invention, the grounding conductor sheet is formed by fitting knitted metallic fibers to a film sheet or a meshed sheet. Accordingly, the modulus of elasticity of the surface of the grounding conductor is relatively low so that thermal stress generated due to a change in the surrounding temperature is eased and degradation in the antenna performance due to thermal deformation is prevented. Further, the gross weight of metal used to construct the grounding conductor is reduced so that the weight of the flat antenna device is reduced.

In further accordance with the invention, the grounding conductor sheet is formed by embroidering metallic fibers on a film sheet or a meshed sheet. Accordingly, the modulus of elasticity of the surface of the grounding conductor is relatively low so that thermal stress generated due to a change in the surrounding temperature is eased and degradation in the antenna performance due to thermal deformation is prevented. Further, the gross weight of metal used to construct the grounding conductor is reduced so that the weight of the flat antenna device is reduced.

In further accordance with the invention, a flat antenna device comprises a radiation element sheet formed by fitting metallic radiation elements having a large number of holes to a film sheet or a meshed sheet, a grounding conductor sheet having a metallic grounding conductor, a picture-frame member provided between the radiation element sheet and the grounding conductor sheet, and feeder means for feeding power to the radiation elements. Accordingly, the modulus of elasticity of the surface of the radiation element is relatively low so that thermal stress generated due to a change in the surrounding temperature is eased and degradation in the antenna performance due to thermal deformation is prevented. Further, the gross weight of metal used to construct the grounding conductor is reduced so that the weight of the flat antenna device is reduced.

In further accordance with the invention, the radiation element sheet is constructed such that a metallic coat is applied to a meshed sheet so that radiation elements have a meshed distribution. Accordingly, thermal stress generated due to a change in the surrounding temperature is eased so that deterioration in performance due to thermal deformation is prevented. Further, the gross weight of metal used to construct the radiation element is reduced so that the weight of the flat antenna device is reduced.

In further accordance with the invention, the radiation element sheet is formed by fitting a compact of metallic fibers to a film sheet or a meshed sheet. Accordingly, the modulus of elasticity of the surface of the radiation element is relatively low so that thermal stress generated due to a change in the surrounding temperature is eased and deterioration in the antenna performance due to thermal deformation is prevented. Further, the gross weight of metal used to construct the radiation elements is reduced so that the weight of the flat antenna device is reduced.

In further accordance with the invention, the radiation element sheet is formed by fitting knitted metallic fibers to a film sheet or a meshed sheet. Accordingly, the modulus of elasticity of the surface of the radiation element is relatively low so that thermal stress generated due to a change in the surrounding temperature is eased and deterioration in the antenna performance due to thermal deformation. Further, the gross weight of metal used to construct the radiation elements is reduced so that the weight of the flat antenna device is reduced.

In further accordance with the invention, the radiation element sheet is formed by embroidering metallic fibers on a film sheet or a meshed sheet. Accordingly, the modulus of elasticity of the surface of the grounding conductor is relatively low so that thermal stress generated due to a change in the surrounding temperature is eased and deterioration in the antenna performance due to thermal deformation is prevented. Further, the gross weight of metal used to construct the radiation elements is reduced so that the weight of the flat antenna device is reduced.

In further accordance with the invention, both the grounding conductor sheet and the radiation element sheet are constructed such that a metallic member with a large number of holes formed therein is fitted to a film sheet or meshed sheet. Thus, thermal stress generated due to a change in the surrounding temperature is eased in both the ground conductor sheet and the radiation element sheet so that deterioration in the antenna performance due to thermal deformation is prevented and the weight of the flat antenna device is reduced.

What is claimed is:

1. A flat antenna device comprising:

a radiation element sheet including a metallic radiation element on a sheet selected from the group consisting of a film and a mesh, said radiation element sheet having a coefficient of thermal expansion;

a grounding conductor sheet having a metallic grounding conductor and a coefficient of thermal expansion;

a frame having a central opening and disposed between and joined to said radiation element sheet and said grounding conductor sheet, said frame having a coefficient of thermal expansion smaller than the coefficients of thermal expansion of said radiation sheet and said grounding conductor sheet, thereby maintaining said radiation element sheet and said grounding conductor sheet taut at temperatures lower than a temperature at which said radiation element sheet and said grounding conductor sheet are joined to said frame; and feeder means for feeding power to said radiation element.

2. The flat antenna device as claimed in claim 1, wherein said metallic grounding conductor is attached to a surface of one of said film and said mesh.

3. The flat antenna device as claimed in claim 1, including a plurality of radiation element sheets and a plurality of frames laminated upon one another.

4. The flat antenna device as claimed in claim 1, wherein said radiation element sheet and said grounding conductor sheet are disposed so that a surface of said radiation element sheet carrying said radiation element and a surface of said grounding conductor sheet carrying said grounding conductor are opposite each other.

5. A flat antenna device comprising:

a radiation element sheet including a metallic radiation element on a sheet selected from the group consisting of a film and a mesh, said radiation element sheet having a coefficient of thermal expansion;

a grounding conductor sheet including a metallic grounding conductor having holes, joined to a second sheet selected from the group consisting of a film and a mesh, the grounding conductor sheet having a coefficient of thermal expansion;

a frame having a central opening and disposed between and joined to said radiation element sheet and said grounding conductor sheet, said frame having a coefficient of thermal expansion smaller than the coefficients of thermal expansion of said radiation sheet and said grounding conductor sheet, thereby maintaining said radiation element sheet and said grounding conductor sheet taut at temperatures lower than a temperature at which said radiation element sheet and said grounding conductor sheet are joined to said frame; and feeder means for feeding power to said radiation element.

6. The flat antenna device as claimed in claim 5, wherein said grounding conductor sheet is a mesh including a metallic coating.

7. The flat antenna device as claimed in claim 5, wherein said grounding conductor sheet includes a compact of metallic fibers.

8. The flat antenna device as claimed in claim 7, wherein said grounding conductor sheet includes metallic fibers knitted to said grounding conductor sheet.

9. The flat antenna device as claimed in claim 7, wherein said grounding conductor sheet includes metallic fibers embroidered to said grounding conductor sheet.

10. A flat antenna device comprising:

a radiation element sheet including a metallic radiation element having a number of holes, on a sheet selected from the group consisting of a film and a mesh;

a grounding conductor sheet having a metallic grounding conductor and a coefficient of thermal expansion;

a frame having a central opening and disposed between and joined to said radiation element sheet and said grounding conductor sheet, said frame having a coefficient of thermal expansion smaller than the coefficients of thermal expansion of said radiation sheet and said grounding conductor sheet, thereby maintaining said radiation element sheet and said grounding conductor sheet taut at temperatures lower than a temperature at which said radiation element sheet and said grounding conductor sheet are joined to said frame; and feeder means for feeding power to said radiation element.

11. The flat antenna device as claimed in claim 10, wherein said radiation element sheet includes a mesh with a metallic coating.

12. The flat antenna device as claimed in claim 10, wherein said radiation element sheet includes a compact of metallic fibers.

13. The flat antenna device as claimed in claim 12, wherein said radiation element sheet includes metallic fibers knitted to said radiation element sheet.

14. The flat antenna device as claimed in claim 10, wherein said radiation element sheet includes metallic fibers embroidered to said radiation element sheet.

15. The flat antenna device as claimed in claim 10, wherein said grounding conductor sheet includes a metallic conductor having a number of holes on a sheet and selected from the group consisting of a film and a mesh.

* * * * *